US007913500B2

(12) United States Patent
Lim et al.

(10) Patent No.: US 7,913,500 B2
(45) Date of Patent: Mar. 29, 2011

(54) CONTROL METHOD FOR A REFRIGERATOR

(75) Inventors: Hyoung Keun Lim, Seoul (KR); Gye Young Song, Seoul (KR)

(73) Assignee: LG Electronics Inc., Seoul (KR)

( * ) Notice: Subject to any disclaimer, the term of this patent is extended or adjusted under 35 U.S.C. 154(b) by 423 days.

(21) Appl. No.: 12/035,723

(22) Filed: Feb. 22, 2008

(65) Prior Publication Data

US 2009/0113902 A1 May 7, 2009

(30) Foreign Application Priority Data

Nov. 5, 2007 (KR) ..... 10-2007-0112130

(51) Int. Cl.
*F25D 21/06* (2006.01)

(52) U.S. Cl. ..... 62/155; 62/131; 62/176.2

(58) Field of Classification Search ..... 62/80, 131, 62/176.2, 151, 155
See application file for complete search history.

(56) References Cited

U.S. PATENT DOCUMENTS

| | | | | |
|---|---|---|---|---|
| 3,460,352 | A | 8/1969 | Lorenz | |
| 3,626,979 | A | 12/1971 | Abell | |
| 4,369,631 | A | 1/1983 | Abraham | |
| 4,528,821 | A * | 7/1985 | Tershak et al. | 62/153 |
| 5,564,286 | A | 10/1996 | Suse | |
| 6,370,895 | B1 | 4/2002 | Sakuma et al. | |
| 6,397,608 | B1 | 6/2002 | Sakuma et al. | |
| 2002/0134095 | A1 | 9/2002 | Temmyo et al. | |
| 2004/0107727 | A1 | 6/2004 | Kim et al. | |
| 2005/0172665 | A1 | 8/2005 | Kim et al. | |
| 2006/0144063 | A1 | 7/2006 | Oh | 62/200 |
| 2007/0033962 | A1 | 2/2007 | Kang et al. | |
| 2007/0144190 | A1 | 6/2007 | Temmyo et al. | |
| 2007/0151289 | A1 | 7/2007 | Youn et al. | |
| 2007/0227166 | A1 | 10/2007 | Rafalovich et al. | |

FOREIGN PATENT DOCUMENTS

| | | |
|---|---|---|
| EP | 2 136 166 | 12/2009 |
| JP | 2002-333254 | 11/2002 |
| JP | 2006-125843 | 5/2006 |

OTHER PUBLICATIONS

International PCT Search Report dated Oct. 23, 2008.
International PCT Search Report dated Mar. 16, 2010.
U.S. Appl. No. 12/035,736 dated Jul. 23, 2010.
U.S. Office Action issued in U.S. Appl. No. 12/035,736 dated Dec. 16, 2010.

* cited by examiner

*Primary Examiner* — Marc E Norman
(74) *Attorney, Agent, or Firm* — Ked & Associates, LLP

(57) ABSTRACT

A refrigerator control method is provided that may efficiently perform a defrosting operation. The method includes performing a normal operation of a refrigerating storage room and a normal operation of a freezing storage room selectively or simultaneously, setting a variable defrosting period, which is varied according to set parameters including the relative humidity of external air, and performing a defrosting operation based on the set defrosting period.

16 Claims, 4 Drawing Sheets

| Relative Humidity (H) | Door opening time period (DT) | Second constant (DT) |
|---|---|---|
| $H_1 \leq H < H_2$ | $T_1 < DT \leq T_2$ | $K_1$ |
| $H > H_2$ | $DT > T_2$ | $K_2$ |
| $H \leq H_1$ | $DT \leq T_1$ | $K_3$ |

FIG. 4

| Relative Humidity (H) | First constant (W) |
|---|---|
| $H < H_1$ | $W_1$ |
| $H_1 \leq H < H_2$ | $W_2$ |
| $H \geq H_2$ | $W_3$ |

FIG. 5

| Relative Humidity (H) | Door opening time period (DT) | Second constant (DT) |
|---|---|---|
| $H_1 \leq H < H_2$ | $T_1 < DT \leq T_2$ | $K_1$ |
| $H > H_2$ | $DT > T_2$ | $K_2$ |
| $H \leq H_1$ | $DT \leq T_1$ | $K_3$ |

CONTROL METHOD FOR A REFRIGERATOR

This application claims priority to Korean Patent Application No. 10-2007-0112130, filed in Korea on Nov. 5, 2007, which is hereby incorporated by reference in its entirety.

BACKGROUND

1. Field

A control method for a refrigerator is disclosed herein.

2. Background

Refrigerator control methods are known. However, they suffer from various disadvantages.

BRIEF DESCRIPTION OF THE DRAWINGS

Embodiments will be described in detail with reference to the following drawings in which like reference numerals refer to like elements, and wherein:

FIG. 4 is a table illustrating a first set of parameters used to control the refrigerator of FIG. 1;

FIG. 5 is a table illustrating a second set parameters used to control the refrigerator of FIG. 1.

DETAILED DESCRIPTION

Figure 1:
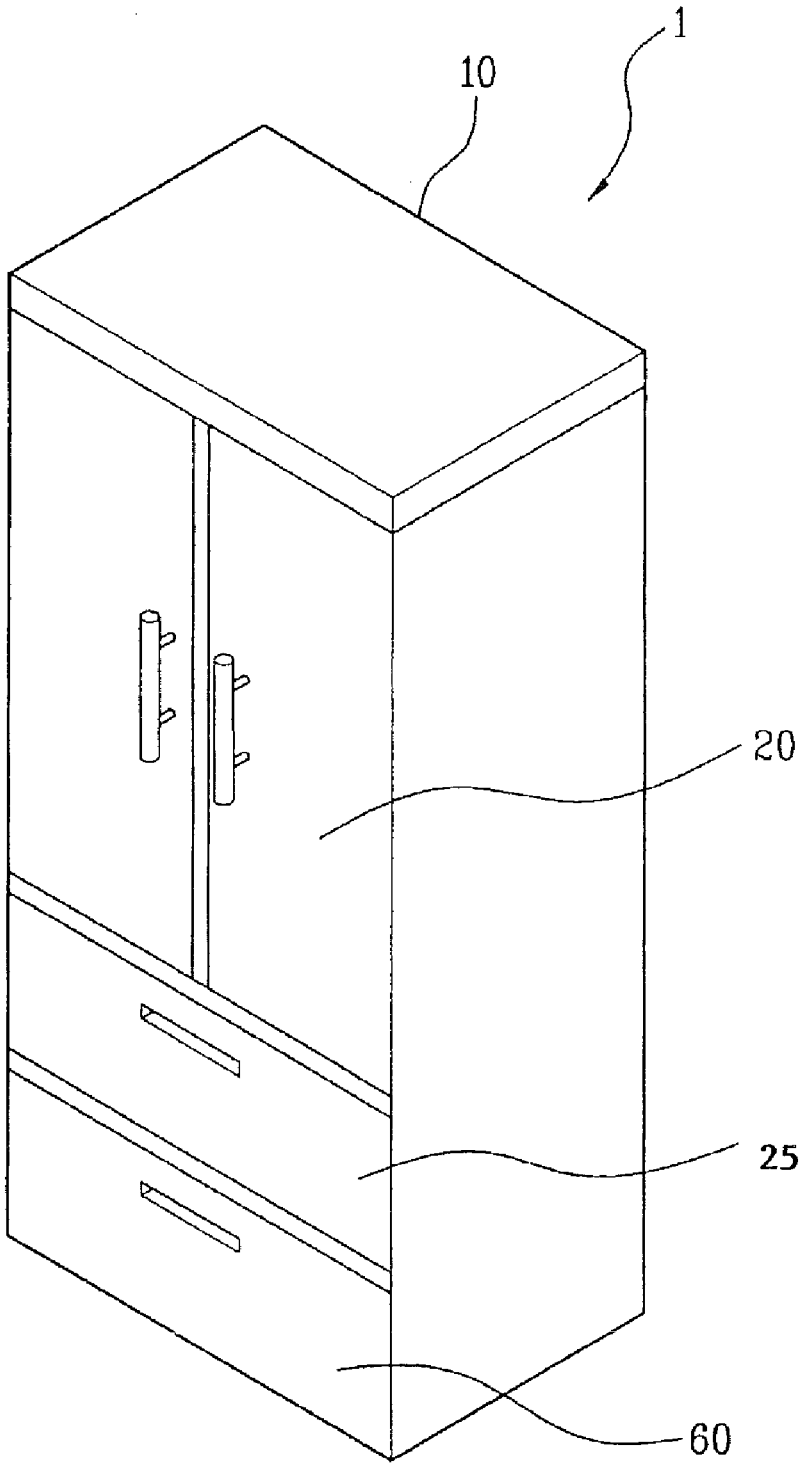
FIG. 1 is a front perspective view of a refrigerator according to an embodiment.

Reference will now be made in detail to embodiments, examples of which are illustrated in the accompanying drawings. In the drawings, like reference numerals have been used to indicate like elements.

Generally, a refrigerator includes a freezing compartment or storage room and a refrigerating compartment or storage room. The refrigerating storage room may be kept at a temperature of approximately 3° C. to 4° C., to keep food and vegetables fresh for a long period of time. The freezing storage room may be kept at a sub-zero temperature, to keep food, meat, and other items, in a frozen state.

The refrigerator may further include an evaporator to supply cold air into the refrigerating storage room and the freezing storage room selectively or simultaneously, in order to perform a refrigerating operation for the refrigerating storage room or a freezing operation for the freezing storage room. During the refrigerating operation for the refrigerating storage room and during the freezing operation for the freezing storage room, moisture in the vicinity of the evaporator is condensed, in the form of frost, on the evaporator. When the evaporator is covered with frost, it causes a deterioration in the thermal efficiency of the evaporator. Therefore, there is a need for removal of the frost. An operation of the refrigerator to remove the frost is conventionally called a "defrosting operation".

The defrosting operation of the refrigerator may be performed only at preset intervals. However, in such a case the defrosting operation may be performed even when it is unnecessary.

Further, a frequent defrosting operation raises an interior temperature of the freezing storage room or the refrigerating storage room, and may have a negative effect on contents stored therein. Furthermore, another problem of the frequent defrosting operations is that it increases consumption of electricity by the refrigerator.

On the other hand, when the defrosting operation is performed only at a fixed time interval, no defrosting operation may be performed until a preset time despite a need for the defrosting operation. This results in deterioration in the thermal efficiency of the evaporator.

A refrigerator according to an embodiment will now be described with reference to FIGS. 1 and 2. The refrigerator 1 of FIG. 1 includes a body 10, a freezing storage room 60 and a refrigerating storage room 20. The refrigerating storage room 20 is located above the freezing storage room 60, and may include double doors. The refrigerator 1 may further include a convertible compartment or storage room 25 that may provide a refrigerating function or a freezing function.

Figure 2:
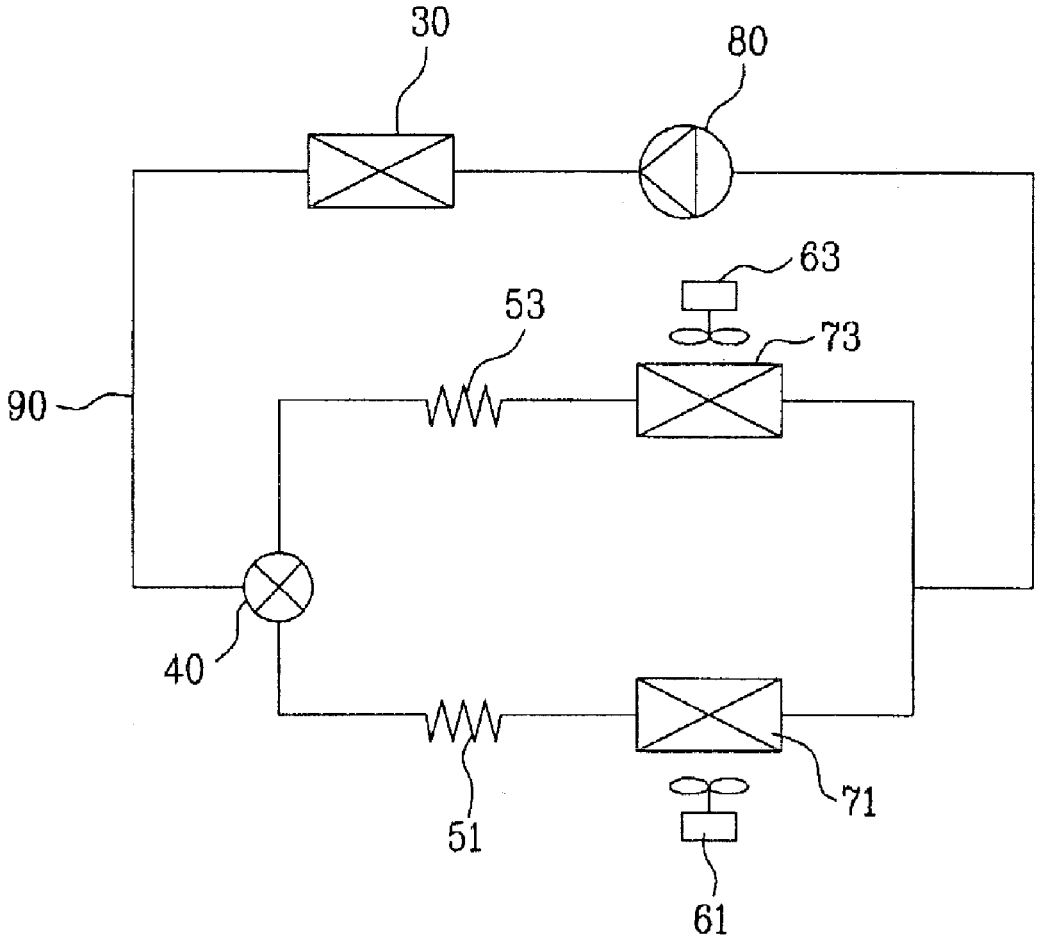
FIG. 2 is a schematic diagram of a refrigerant flow cycle of the refrigerator of FIG. 1.

The refrigerator 1 may further include a compressor 80, a condenser 30, a refrigerant tube 90, a refrigerant control valve 40, expanders 51 and 53, evaporators 71 and 73, and blowing fans 61 and 63, as shown in FIG. 2. The compressor 80 may serve to compress a refrigerant, and the condenser 30 may serve to condense the compressed refrigerant. The refrigerant tube 90 may serve as a flow path to guide the flow of a refrigerant within the refrigerator 1. The refrigerant control valve 40 may be installed on the refrigerant tube 90, and may serve to control the flow of the refrigerant, so as to allow a refrigerating operation for the refrigerating storage room 20 and a freezing operation for the freezing storage room 60 to be performed simultaneously or selectively.

The evaporators 71 and 73 may include a first evaporator 71 that provides the refrigerating operation for the refrigerating storage room 20, and a second evaporator 73 that provides the freezing operation for the freezing storage room 60. The refrigerant control valve 40 may guide the refrigerant to the refrigerating storage room 20, and the refrigerant having passed through the refrigerant control valve 40 may be introduced into the first expander 51, which expands the refrigerant, prior to being introduced into the first evaporator 71. Similarly, the refrigerant control valve 40 may guide the refrigerant to the freezing storage room 60, and the refrigerant may be introduced into a second expander 53, which expands the refrigerant, prior to being introduced into the second evaporator 73.

A first blowing fan 61 may be provided at a side of the first evaporator 71, to facilitate heat exchange by the first evaporator 71, for example, heat exchange between the refrigerant and the surrounding air. A second blowing fan 63 may be provided at a side of the second evaporator 73, to facilitate heat exchange by the second evaporator 73. The refrigerant may be guided into the first evaporator 71 and the second evaporator 73 simultaneously or selectively, to cool the refrigerating storage room 20 and/or the freezing storage room 60.

Figure 3:
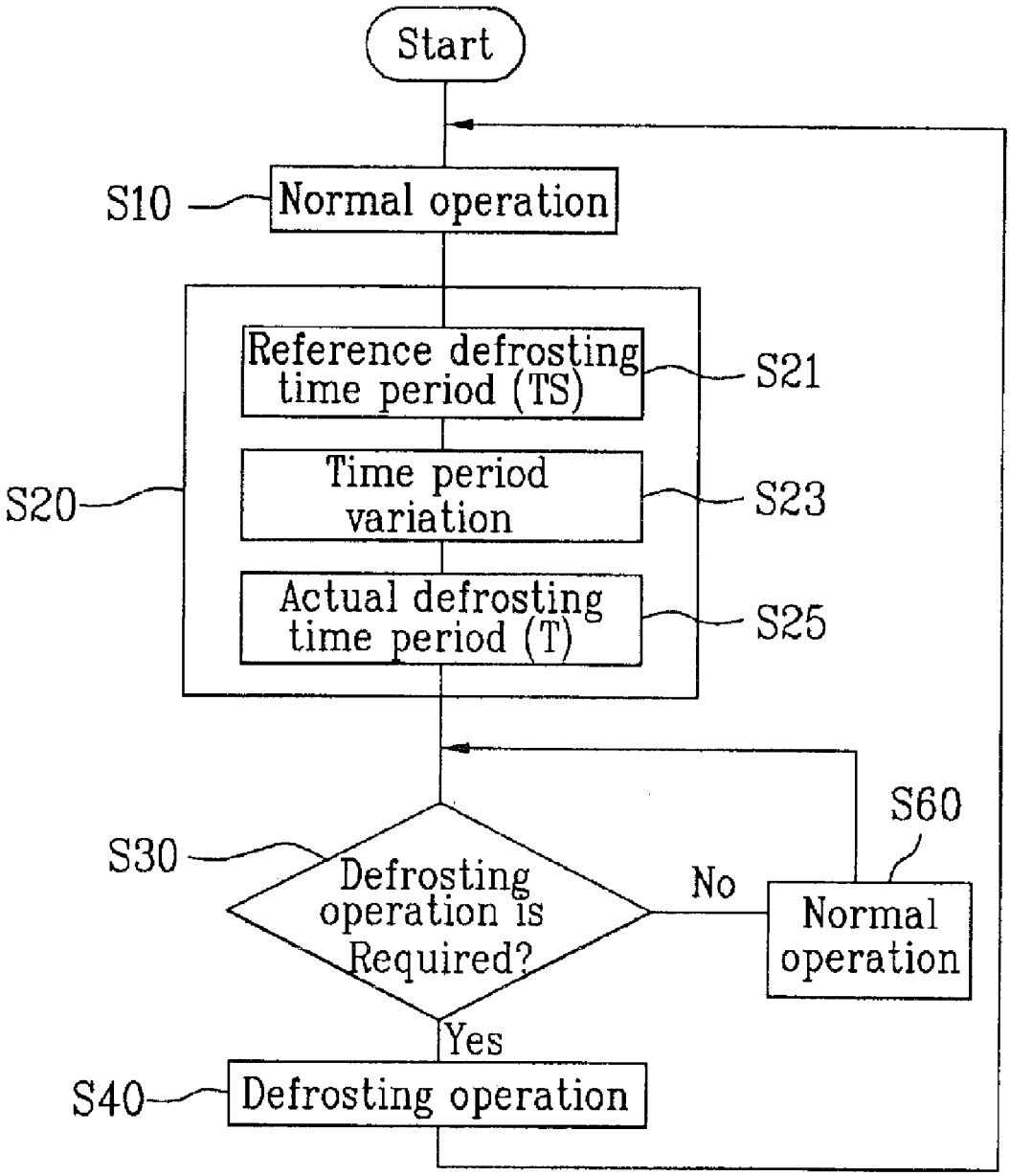
FIG. 3 is a flow chart of a refrigerator control method according to an embodiment.

Hereinafter, a refrigerator control method according to an embodiment will be described in detail with reference to FIG. 3. The refrigerator control method illustrated in FIG. 3 may include a normal operation including operating the refrigerating storage room and the freezing storage room simultaneously or selectively, in step S10, and a defrosting operation including performing a defrosting operation on the refrigerating storage room evaporator or the freezing storage room evaporator, in step S40, used in the normal operation of step S10.

The refrigerator control method may further include setting a variable defrosting time period, in step S20. The variable defrosting time period may be varied according to set parameters including a relative humidity of external air. The parameters may vary according to information on a state of the external air including a temperature of the external air. The parameters may further include an opening time period DT of a refrigerator door. The opening time period DT of the refrigerator door may include information about a time period for which the refrigerator door is maintained in an opened state during a single opening operation. The opening time period DT of the refrigerator door also may include information about a time the door is opened during a specific period of time.

Prior to performing the defrosting operation, the refrigerator control method may further include determining whether or not normal operation times of the refrigerating storage room and the freezing storage room reach a preset defrosting time, in step S30. The defrosting time period may be preset in a controller of the refrigerator. If the normal operation time of the refrigerating storage room or the normal operation time of the freezing storage room reaches the preset defrosting time, the defrosting operation may be performed in step S40. On the other hand, if the normal operation time does not reach the preset defrosting time, the normal operation may be continuously performed, in step S60.

The time period setting in step S20 may include setting a reference defrosting time period TS, in step S21, calculating a variation of the time period P according to the set parameters, in step S23, and setting an actual defrosting time period T on the basis of the reference defrosting period and the variation of the time period. The reference defrosting time period may be preset in a controller. The refrigerator control method may further include calculating a new variation of the time period according to a changed external environment after ending the defrosting operation, and resetting a new defrosting time period on the basis of the calculated variation of the time period.

According to the refrigerator control method of this embodiment, by repeatedly performing the above described sequence, the defrosting time period may be continuously reset in consideration of the set parameters, which may be varied according to the external environment. The reference defrosting period may be set differently according to a kind of the refrigerator, and also, may be set differently according to an area where the refrigerator is used. Also, the reference defrosting time period may be previously set at a fixed value by a user in consideration of a capacity or purpose of use of the refrigerator.

The variation of the time period may be set on the basis of various external environmental factors. For example, the parameters may include a relative humidity H of the external air and an opening time period DT of the door of the refrigerator. A detailed description follows with reference to FIGS. 4 and 5.

Once the reference defrosting time period TS and the variation of the time period P are determined, an actual defrosting operation time period T may be set. For example, the actual defrosting operation time period may be a value obtained by deducting the variation of the period from the reference defrosting time period. Thus, with due consideration to the preset reference defrosting time period and the variation of the time period according to the external environment, a defrosting operation suitable for an actual operating mode may be performed.

If the relative humidity H of the external air is high, conventionally, the humidity of air introduced into the refrigerator is high. Consequently, if the humidity of the air inside the refrigerator is high, the air contains a great deal of moisture. Therefore, there is a high probability of generating frost, in the vicinity of the first evaporator 71 and/or the second evaporator 73. Thus, if the humidity of the external air is high, it is necessary to shorten the defrosting operation time period, to increase the frequency of the defrosting operation.

Also, if the opening time of the door is long, it may cause the release of a large amount of cold air from the refrigerator. This presents a need for operating the evaporator for a significantly extended period of time, and consequently, may result in moisture in the vicinity of the evaporator to change to frost. In conclusion, when the opening time period of the door increases, it may be necessary to shorten the defrosting period of the defrosting operation, thereby allowing the defrosting operation to be performed for a shortened time interval.

Here, the actual defrosting time period T represents the normal operation time period of the freezing storage room or the normal operation time of the refrigerating storage room after a primary defrosting operation is ended and before a new defrosting operation begins. The normal operation time may be set on the basis of the operation and ending of operation of the compressor, the operation and ending of operation of the blowing fan used during the normal operation, and the opening and closing of the refrigerant control valve used to control the flow of the refrigerant during the normal operation.

More specifically, the normal operation time of the refrigerating storage room 20 may be set to a total sum of the operating time of the first blowing fan 61 during the refrigerating operation for the refrigerating storage room 20 in a state in which the compressor 80 is operated and the refrigerant control valve 40 guides the refrigerant into the refrigerating storage room 20. The normal operating time of the freezing storage room 60 may be set to a total sum of the operating time of the second blowing fan 63 during the freezing operation for the freezing storage room 60 in a state in which the compressor 80 is operated and the refrigerant control valve 40 guides the refrigerant into the freezing storage room 60.

In conclusion, the normal operating time of the refrigerating storage room and the normal operating time of the freezing storage room represent an actual time consumed as the refrigerant is actually supplied into the refrigerating storage room evaporator or the freezing storage room evaporator to perform the refrigerating operation for the refrigerating storage room or the freezing operation for the freezing storage room.

Meanwhile, calculating the variation of the time period P may include measuring the relative humidity of external air, measuring the opening time of the refrigerator door, determining a first set parameter that is variable according to the relative humidity, and determining a second set parameter that is variable according to the opening time of the refrigerator door.

The variation of the period may be determined by the following equation (i):

$$P=\text{sum}(W*DT)+K \qquad \text{Eq. (i)}$$

Where, P is the variation of the time period, DT is the opening time period of the refrigerator door, W is the first set parameter, and K is the second set parameter.

The first set parameter W may be determined according to the relative humidity of the external air, and may have a dimensionless unit. The second set parameter K may be determined according to the relative humidity of the external air and the opening time period of the refrigerator door upon a single opening operation, and may have a unit of time.

For example, as shown in FIG. 4, if the relative humidity H of the external air is smaller than a first relative humidity H1, the first set parameter W may have a value of W1. If the relative humidity H of the external air is equal to or larger than the first relative humidity H1, but is smaller than a second relative humidity H2, the first set parameter W may have a value of W2. Also, if the relative humidity H of the external air is larger than the second relative humidity H2, the first set parameter W may have a value of W3.

Meanwhile, as shown in FIG. 5, if the relative humidity H of the external air is larger than the first relative humidity H1, but is smaller than or equal to the second relative humidity H2, and the opening time period DT of the refrigerator door is larger than a first set time period T1, but is smaller than or equal to a second set time period T2, the second set parameter K may have a value of K1. Also, if the relative humidity H of the external air is larger than the second relative humidity H2 and the opening time period DT of the refrigerator door is larger than the second set time period T2, the second set parameter K may have a value of K2. Also, if the relative humidity H of the external air is equal to, or smaller than the first relative humidity H1 and the opening time period DT of the refrigerator door is equal to, or is smaller than the first set time period T1, the second set parameter K may have a value of K3.

Embodiments disclosed herein provide a refrigerator control method that may reduce consumption of electricity due to an inefficient defrosting operation. Further, embodiments disclosed herein provide a refrigerator control method that has a lesser effect on contents stored in a freezing storage room or refrigerating storage room during a defrosting operation.

Embodiments disclosed herein provide a refrigerator control method that includes performing a normal operation of a refrigerating storage room and a normal operation of a freezing storage room selectively or simultaneously, setting a variable defrosting period, which is varied according to set parameters including the relative humidity of external air, and performing a defrosting operation based on the set defrosting period. The set parameters may further include an opening time of a refrigerator door.

The setting of the defrosting period may include setting a reference defrosting period, calculating a variation of period according to the set parameters, and setting an actual defrosting period on the basis of the reference defrosting period and the variation of period. The calculation of the variation of period may include measuring the relative humidity of external air, measuring an opening time of a refrigerator door, determining a first set parameter, which is variable according to the relative humidity, and determining a second set parameter, which is variable according to the relative humidity and the opening time of the refrigerator door.

The refrigerator control method may further include determining whether or not normal operation times of the freezing storage room and the refrigerating storage room reach the actual defrosting period. Each normal operation time may be set on the basis of the operation and suspension of the compressor, the operation and suspension of a blowing fan used during the normal operation, and the opening and closing of a refrigerant control valve used to control the flow of a refrigerant during the normal operation.

The normal operation time of the refrigerating storage room may be set to the total sum of an operating time of a first blowing fan during a refrigerating operation for the refrigerating storage room in a state wherein the compressor is operated and the refrigerant control valve guides the refrigerant into the refrigerating storage room. The normal operation time of the freezing storage room may be set to the total sum of an operating time of a second blowing fan during a freezing operation for the freezing storage room in a state in which the compressor is operated and the refrigerant control valve guides the refrigerant into the freezing storage room.

The refrigerator control method may further include calculating a new variation of period according to the changed external environment after ending the defrosting operation, and resetting a new defrosting period on the basis of the calculated variation of period. The opening time of the refrigerator door may include information about a time of keeping the refrigerator door in an opened state upon a single opening operation. The opening time of the refrigerator door may include information about the opening number of the door for a specific time.

A refrigerator control method according to embodiments disclosed herein has at least the following advantages. First, according to embodiments disclosed herein, since a defrosting operation is performed on the basis of a defrosting period determined in consideration of the external environment, the defrosting operation may be performed at an appropriate time point when the refrigerator requires the defrosting operation. Second, as a result of setting the defrosting period in consideration of the external environment and performing the defrosting operation on the basis of a refrigerating storage room operating time or freezing storage room operating time, it may be possible to eliminate an unnecessary defrosting operation and reduce consumption of electricity. Third, by reducing the unnecessary defrosting operation, it may be possible to reduce a probability of raising the interior temperature of a refrigerating storage room or freezing storage room due to the defrosting operation. This may reduce a negative effect on food due to the raised temperature.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a refrigerator, the method comprising:

performing a normal operation of a refrigerating storage room and a normal operation of a freezing storage room selectively or simultaneously;

setting a defrosting time period, which is varied according to certain parameters; and performing a defrosting operation based on the set defrosting time period, wherein setting the defrosting time period comprises:

setting a reference defrosting time period;

calculating a variation of the time period according to the parameters, comprising:

measuring a relative humidity of external air;

measuring an opening time of a door of the refrigerator;

determining a first constant, which is variable according to the relative humidity; and determining a second constant, which is variable according to the relative humidity and the opening time of the refrigerator door; and setting an actual defrosting time period on the basis of the reference defrosting time period and the variation of the time period.

2. The method of claim 1, wherein the certain parameters include the relative humidity of external air.

3. The method of claim 2, wherein the certain parameters further include the opening time period of the door of the refrigerator.

4. The method of claim 3, wherein the opening time period of the refrigerator door includes information about a time of maintaining the refrigerator door in an opened state during a single opening operation.

5. The method of claim 3, wherein the opening time period of the refrigerator door includes information about a number of times the door is opened during a predetermined time period.

6. The method of claim 1, wherein the reference defrosting time period is preset in a controller.

7. The method of claim 1, wherein the actual defrosting time period is determined by subtracting the variation of the time period from the reference defrosting time period.

8. The method of claim 1, further comprising determining whether normal operation times of the freezing storage room and normal operation times of the refrigerating storage room are equal to the actual defrosting time period.

9. The method of claim 8, wherein the actual defrosting time period of the freezing storage room is differently set from the actual defrosting time period of the refrigerating storage room.

10. The method of claim 8, wherein each normal operation time is set on the basis of operation and ending of operation of a compressor, operation and suspension of a blowing fan used during the normal operation, and opening and closing of a refrigerant control valve used to control a flow of a refrigerant during the normal operation.

11. The method of claim 10, wherein the normal operation time period of the refrigerating storage room is set to a sum of an operating time period of a first blowing fan during a refrigerating operation for the refrigerating storage room in a state in which the compressor is operated and the refrigerant control valve guides the refrigerant into the refrigerating storage room.

12. The method of claim 10, wherein the normal operation time period of the freezing storage room is set to a sum of an operating time period of a second blowing fan during a freezing operation for the freezing storage room in a state in which the compressor is operated and the refrigerant control valve guides the refrigerant into the freezing storage room.

13. The method of claim 1, further comprises calculating a new variation of the time period according to a changed external environment after ending the defrosting operation, and resetting a new defrosting time period on the basis of the calculated variation of the time period.

14. A method of controlling a refrigerator, the method comprising:

performing a normal operation of a refrigerating storage room and a normal operation of a freezing storage room selectively or simultaneously;

setting a defrosting time period, which is varied according to parameters including information on a state of external air; and performing a defrosting operation based on the set defrosting time period, wherein setting the defrosting time period comprises:

setting a reference defrosting time period;

calculating a variation of the time period according to the parameters, comprising:

measuring a relative humidity of external air;

measuring an opening time of a door of the refrigerator;

determining a first constant, which is variable according to the relative humidity; and determining a second constant, which is variable according to the relative humidity and the opening time of the refrigerator door; and setting an actual defrosting time period on the basis of the reference defrosting time period and the variation of the time period.

15. The method of claim 14, wherein the information on the state of the external air includes a temperature of the external air.

16. A method of controlling a refrigerator, the method comprising:

performing a normal operation of a refrigerating storage room and a normal operation of a freezing storage room selectively or simultaneously;

setting a defrosting time period, which is varied according to certain parameters, comprising:

setting a reference defrosting time period;

calculating a variation of the time period according to the parameters; and setting an actual defrosting time period on the basis of the reference defrosting time period and the variation of the time period;

performing a defrosting operation based on the set defrosting time period; and determining whether normal operation times of the freezing storage room and normal operation times of the refrigerating storage room are equal to the actual defrosting time period.

* * * * *